US008834053B2

(12) United States Patent
Van Landingham, Jr. et al.

(10) Patent No.: US 8,834,053 B2
(45) Date of Patent: Sep. 16, 2014

(54) MOP HANDLE GRIP AND THUMB TRIGGER MECHANISM

(75) Inventors: Alfred Reneau Van Landingham, Jr., Stephens City, VA (US); Robert Lauer, Winchester, VA (US); Mark Allen Hoyle, Winchester, VA (US)

(73) Assignee: Rubbermaid Commercial Products, LLC, Winchester, VA (US)

( * ) Notice: Subject to any disclaimer, the term of this patent is extended or adjusted under 35 U.S.C. 154(b) by 596 days.

(21) Appl. No.: 12/882,775

(22) Filed: Sep. 15, 2010

(65) Prior Publication Data

US 2011/0064513 A1 Mar. 17, 2011

Related U.S. Application Data

(60) Provisional application No. 61/243,388, filed on Sep. 17, 2009.

(51) Int. Cl.

| | |
|---|---|
| ***A47L 13/26*** | (2006.01) |
| ***A47L 13/22*** | (2006.01) |
| ***A46B 5/00*** | (2006.01) |
| ***A46B 11/00*** | (2006.01) |

(52) U.S. Cl.

CPC ..... *A46B 11/001* (2013.01); *A47L 13/22* (2013.01); *A46B 5/0054* (2013.01); *A46B 5/0058* (2013.01); *A46B 2200/302* (2013.01)

USPC ..... 401/138; 401/139

(58) Field of Classification Search

CPC ..... A47L 13/22; A47L 13/26; A47L 13/225; A47L 13/312

USPC ..... 401/138–140, 275, 282; 134/6; 15/115, 15/116.1, 116.2, 228, 229.6, 229.13, 320, 15/403

See application file for complete search history.

(56) References Cited

U.S. PATENT DOCUMENTS

| | | | | |
|---|---|---|---|---|
| 3,028,615 | A * | 4/1962 | Helm | 15/50.1 |
| RE25,556 | E * | 4/1964 | Nohl et al. | 401/138 |
| 3,603,694 | A * | 9/1971 | Hamm | 401/150 |
| 5,887,309 | A * | 3/1999 | Lin | 15/119.2 |
| 6,394,683 | B1 * | 5/2002 | Pao | 401/289 |
| 6,421,862 | B2 * | 7/2002 | Lesco et al. | 8/158 |
| 6,842,942 | B2 * | 1/2005 | Morgan et al. | 15/414 |

(Continued)

OTHER PUBLICATIONS

International Searching Authority, International Search Report dated Nov. 5, 2010 issued for International Application No. PCT/US2010/049054.

(Continued)

*Primary Examiner* — David Walczak
*Assistant Examiner* — Jennifer C Chiang
(74) *Attorney, Agent, or Firm* — Dennis J. Williamson; Moore & Van Allen PLLC

(57) ABSTRACT

A mop comprises a mop head and a handle connected to the mop head at a pivot. The mop head and handle have a front and a back. A fluid reservoir for spraying a fluid at the front of the mop head. A trigger is disposed on the handle remote from the mop head, where the trigger controls the spraying of the fluid from the reservoir. The trigger is movable between a non-actuated position and an actuated position where the trigger moves toward the back as it moves from the non-actuated position to the actuated position. A method of using the mop is also provided.

20 Claims, 6 Drawing Sheets

(56) References Cited

U.S. PATENT DOCUMENTS

| | | | | |
|---|---|---|---|---|
| 6,868,989 | B2 | 3/2005 | Fahy et al. | |
| 7,048,804 | B2 * | 5/2006 | Kisela et al. | 134/21 |
| 7,191,486 | B1 * | 3/2007 | Michelson et al. | 15/228 |
| 7,296,943 | B2 * | 11/2007 | Sandoval | 401/140 |
| 7,690,070 | B2 * | 4/2010 | Jung | 15/144.1 |
| 7,708,484 | B2 * | 5/2010 | Tanaka et al. | 401/138 |
| 7,708,485 | B2 * | 5/2010 | Tanaka et al. | 401/138 |
| 7,722,273 | B2 * | 5/2010 | Tanaka et al. | 401/138 |
| 8,069,520 | B2 * | 12/2011 | Mattucci et al. | 15/4 |
| 8,171,592 | B2 * | 5/2012 | Tsai | 15/98 |
| 8,241,427 | B1 * | 8/2012 | Crawford et al. | 134/6 |
| 8,246,263 | B2 * | 8/2012 | Bober et al. | 401/48 |
| 2003/0103795 | A1 | 6/2003 | Hollars et al. | |
| 2004/0223803 | A1 * | 11/2004 | Fahy et al. | 401/190 |
| 2005/0089360 | A1 * | 4/2005 | Garabedian et al. | 401/279 |
| 2008/0107471 | A1 | 5/2008 | Fitzpatrick et al. | |
| 2009/0097902 | A1 | 4/2009 | Lemmon | |
| 2011/0158740 | A1 * | 6/2011 | Kandasamy et al. | 401/270 |
| 2012/0227763 | A1 * | 9/2012 | Hayes et al. | 134/6 |

OTHER PUBLICATIONS

International Searching Authority, Written Opinion dated Nov. 5, 2010, issued for International Application No. PCT/US2010/049054.

International Searching Authority, International Preliminary Report on Patentability dated Mar. 20, 2012 issued for International Application No. PCT/US2010/049054.

* cited by examiner

MOP HANDLE GRIP AND THUMB TRIGGER MECHANISM

This application claims benefit of priority under 35 U.S.C. §119(e) to the filing date of to U.S. Provisional Application No. 61/243,388, as filed on Sep. 17, 2009, which is incorporated herein by reference in its entirety.

BACKGROUND

One type of mop comprises a mop head attached to a handle. The handle is disposed generally vertically and the mop is moved in a figure 8 motion as the user walks backward pulling the mop toward the user. Such mops are designed for the handle to be gripped overhand and moved in a back and forth mopping action. A fluid reservoir may be mounted on the mop that dispenses a fluid on the floor when a trigger is activated. This type of mop requires that the user release his or her grip on the handle with one hand in order to actuate the trigger with the fingers of that hand. These mops also do not meet the requirements to be displayed in a quarter pallet.

SUMMARY OF THE INVENTION

A mop comprises a mop head and a handle connected to the mop head at a pivot. The mop head and handle define a front and a rear of the mop. A fluid reservoir for spraying a fluid at the front of the mop head. A trigger is disposed on the handle remote from the mop head, where the trigger controls the spraying of the fluid from the reservoir. The trigger is movable between a non-actuated position and an actuated position where the trigger moves toward the rear of the mop as it moves from the non-actuated position to the actuated position.

The mop may comprise a pad secured to the mop head. The pivot may allow the mop head to pivot relative to the handle about a first axis and a second axis arranged perpendicularly to the first axis. The fluid reservoir may be mounted on the handle. A hand grip may be mounted on the handle adjacent the trigger. The trigger may move a control rod that may be located inside the handle. The trigger may define a hole that extends through the trigger. The hand grip may comprise a four finger grip area. The hand grip may comprise a protective shroud which surrounds the perimeter of the trigger when the trigger is in the non-actuated position. The trigger may be pivotably attached at a hinge to the hand grip. The trigger may comprise a protrusion which presses down on the control rod when the trigger is moved to the actuated position. Less than 10 pounds of pressure is required to move the trigger from the non-actuated position to the actuated position.

A method of using a mop comprises providing a mop comprising a mop head and a handle connected to the mop head at a pivot where the mop head and handle define a front and a rear of the mop, a fluid reservoir for spraying a fluid at the front of the mop head, a trigger disposed on the handle remote from the mop head for controlling the spraying of the fluid where the trigger is movable between a non-actuated position and an actuated position, the trigger moving toward the rear of the mop as it moves from the non-actuated position to the actuated position. The user stands in front of the mop and pulls the front of the mop toward the user as the user walks backward. The user grips the handle with an overhand grip where the handle is in the palm of the user's hand with fingers of the hand facing towards the rear of the mop and the thumb facing upward. The thumb is used to move the trigger toward the rear of the mop. The handle may be moved such that the mop head moves over a surface in a figure 8 motion.

DESCRIPTION OF PREFERRED EMBODIMENTS OF THE INVENTION

Figure 1:
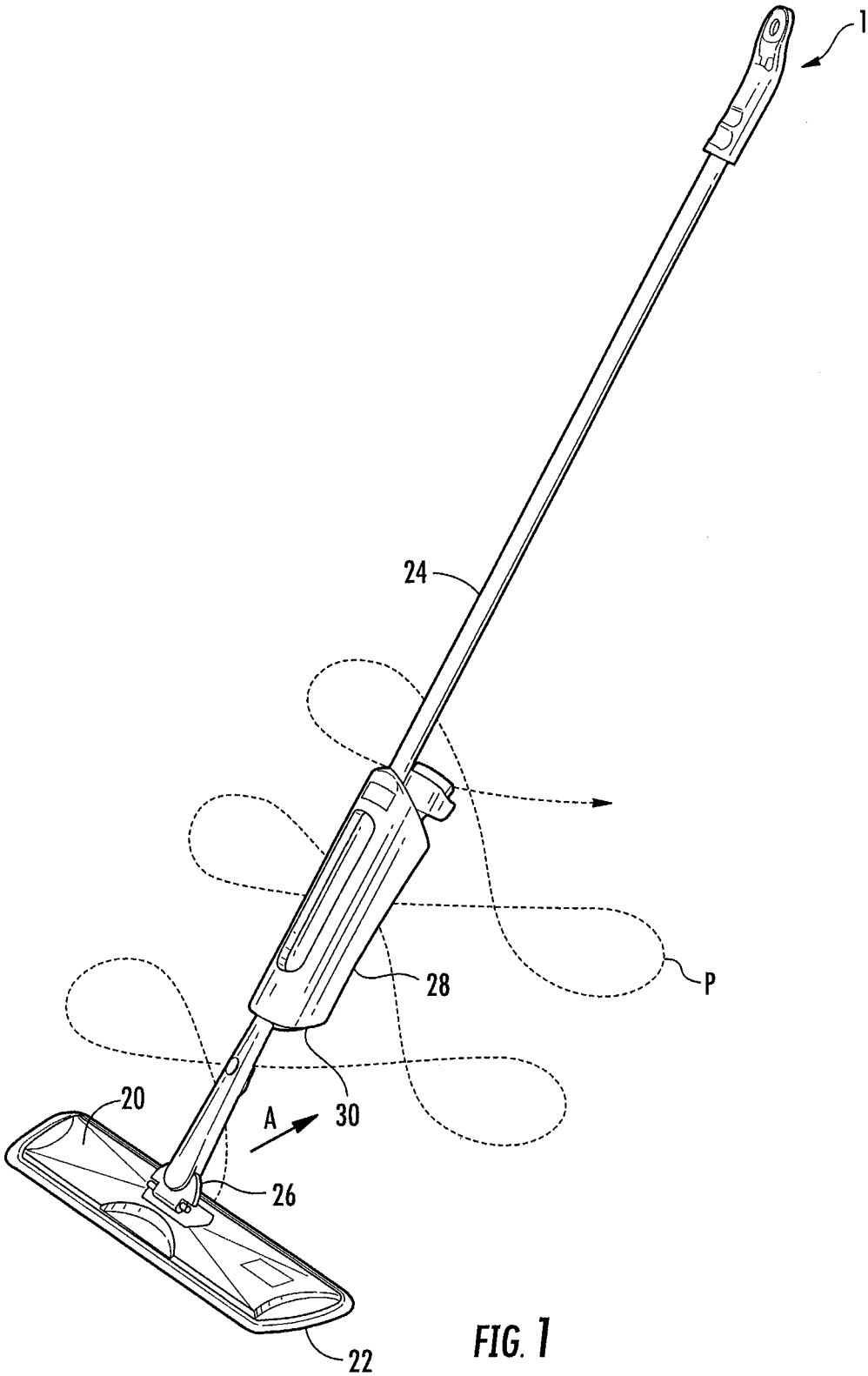
FIG. 1 is a perspective view of an embodiment of a mop with the mop handle and thumb trigger mechanism of the invention.
Figure 2:
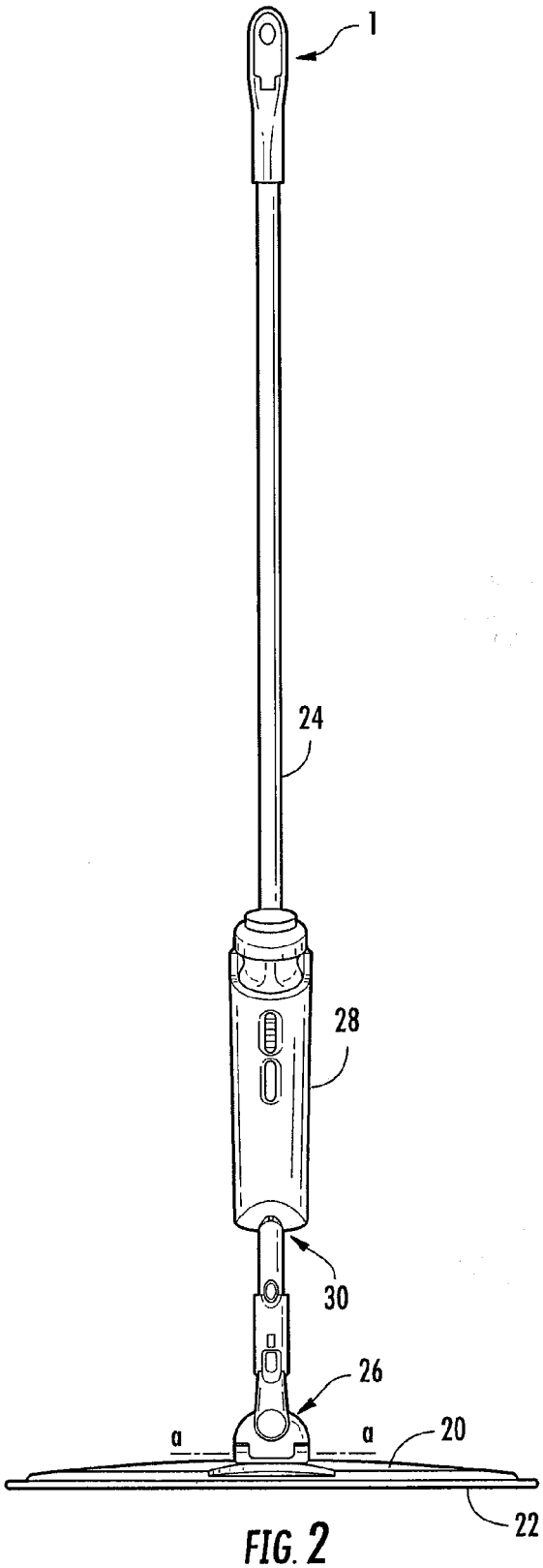
FIG. 2 is a front view of the embodiment of a mop with the mop handle and thumb trigger mechanism of FIG. 1.
Figure 3:
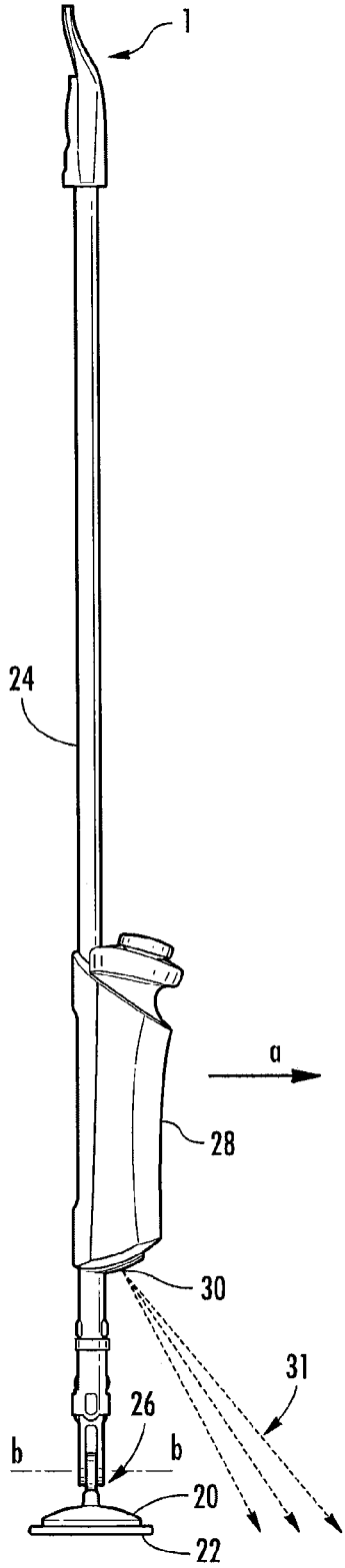
FIG. 3 is a side view of the embodiment of a mop with the mop handle and thumb trigger mechanism of FIG. 1.

An embodiment of the mop is shown in FIGS. 1 through 3, comprising a mop head 20 with a pad 22. Typically, pad 22 is removable from mop head 20 and may either be cleaned or disposed of and replaced. Mop head 20 is connected to handle 24 at pivot 26. Pivot 26 may pivot about a first axis a-a (FIG. 2) and a second axis b-b (FIG. 3) arranged perpendicular to axis a-a. A fluid reservoir 28 is mounted on handle 24 adjacent the mop head 20 at the front of the mop and holds a quantity of cleaning fluid, wax or the like that may be sprayed onto the floor or other surface from nozzle 30 to the front of the mop when a valve, not shown, is opened.

The handle 24 is an elongated member having a mop handle grip and thumb trigger mechanism 1 mounted at the end thereof remote from mop head 20. The handle 24 has a length such that the mop handle grip and thumb trigger mechanism 1 is disposed approximately chest high on a typical user. In the typical use of the mop, the user stands in front of the mop (toward the right as viewed in FIGS. 1 and 3) and pulls the front of the mop toward the user in the direction of arrow A as the user walks backward. Typically, the handle is moved such that the mop head 20 moves over the floor in a figure 8 motion (see pattern P in FIG. 1) as the mop is pulled in the direction of arrow A. The user typically grips the mop handle 24 with an overhand grip where the handle is in the palm of the user's hands with the fingers facing towards the rear of the mop and the thumbs facing upward toward mop handle grip and thumb trigger mechanism 1. One of the user's hands is typically positioned at or near mop handle grip and thumb trigger mechanism 1 and the user's other hand positioned near the center of handle 24.

To dispense fluid from reservoir 28, mop handle grip and thumb trigger mechanism 1 is provided that comprises a grip 6 and a thumb trigger mechanism 2. When the thumb trigger mechanism 2 is actuated a control rod 3 is pushed downward to open the reservoir valve and spray fluid 31 from nozzle 30 of reservoir 28 in front of the mop head 20 as shown in FIG. 3.

Figure 4:
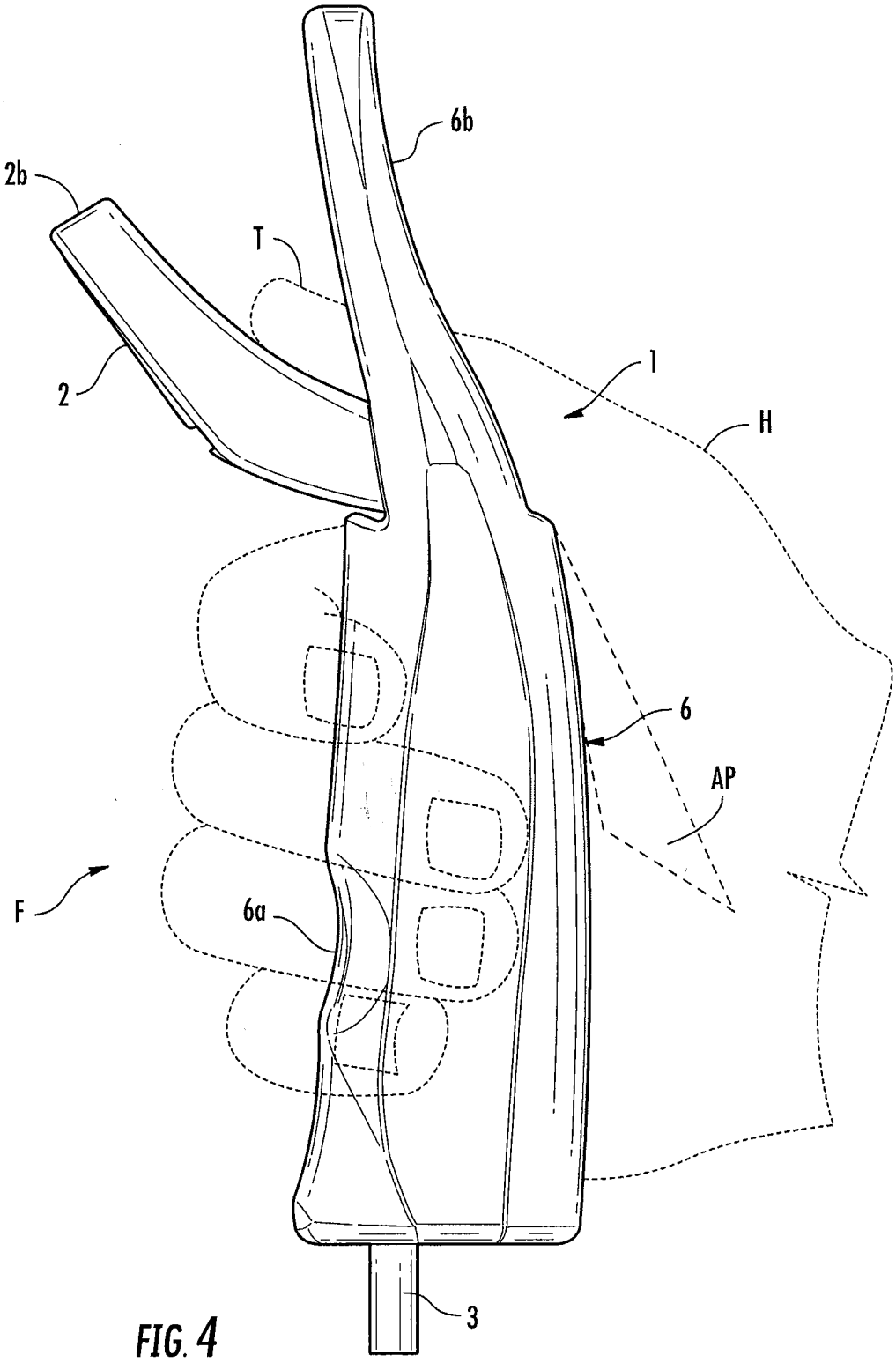
FIG. 4 is a side view of the embodiment of the mop handle and thumb trigger mechanism of FIG. 1.
Figure 5:
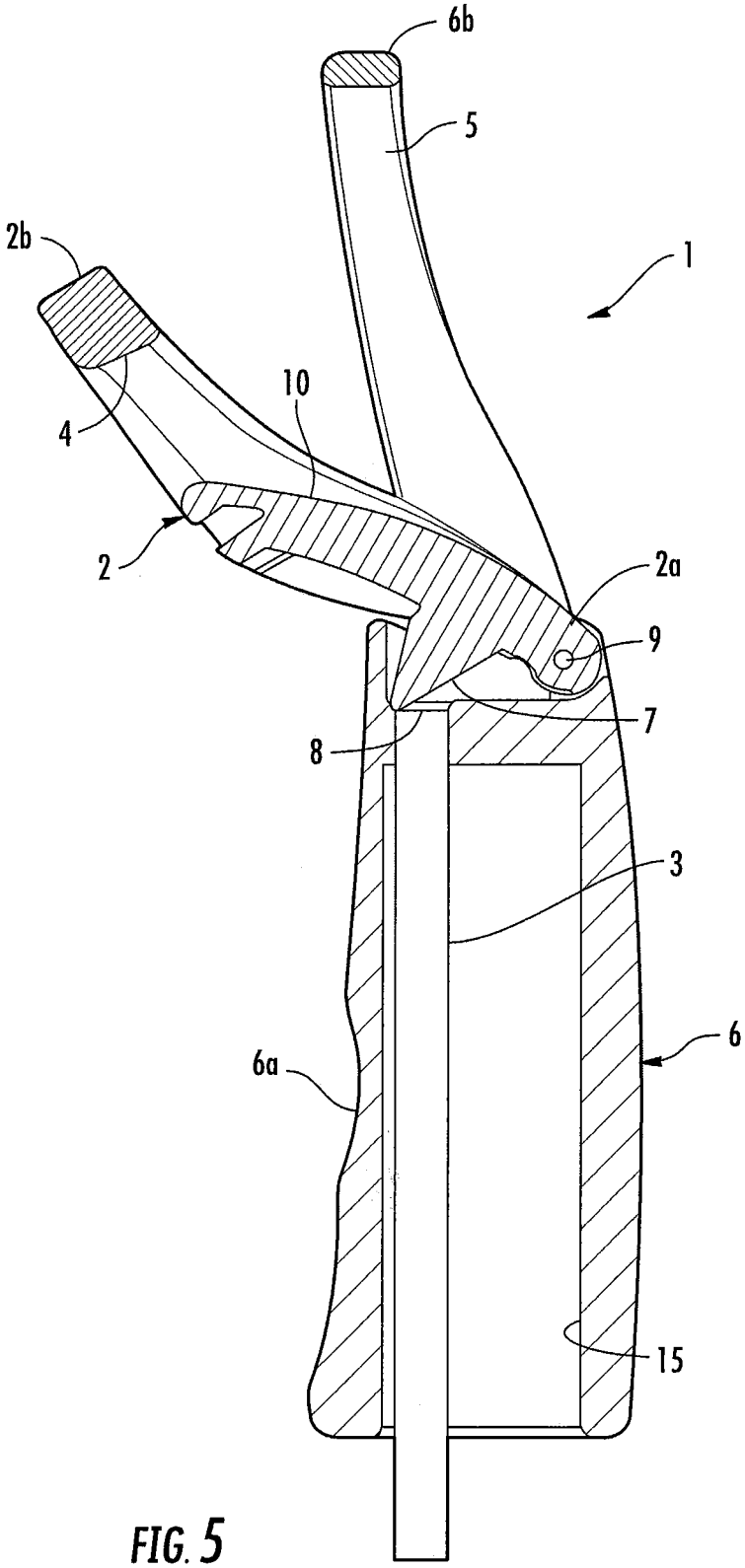
FIG. 5 is a side section view of the embodiment of the mop handle and thumb trigger mechanism of FIG. 1.
Figure 6:
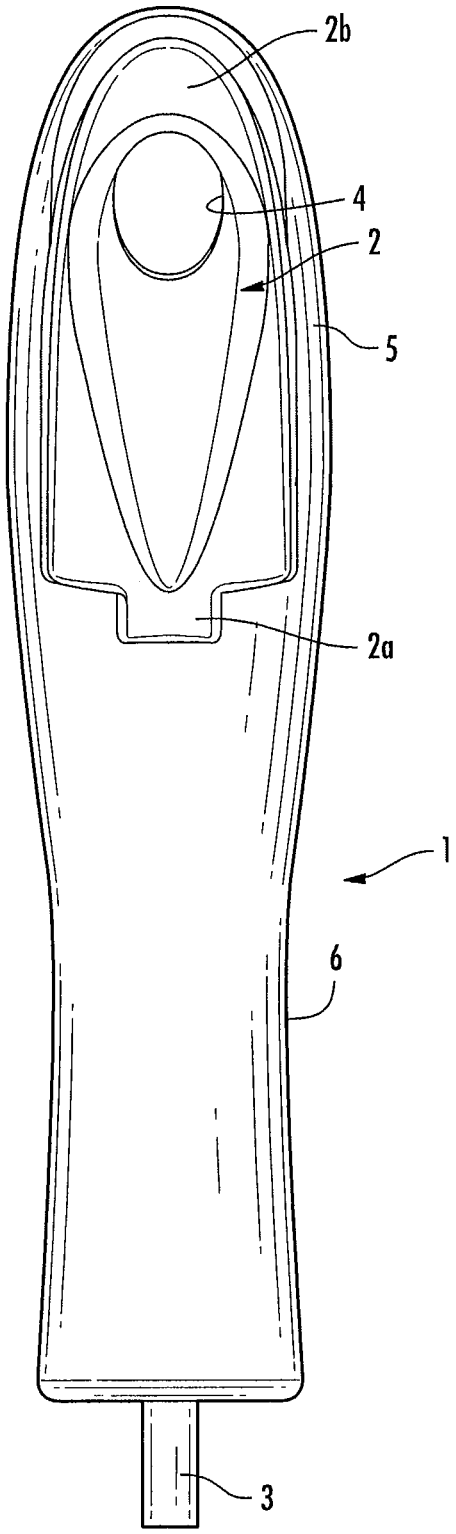
FIG. 6 is a front view of the embodiment of the mop handle and thumb trigger mechanism of FIG. 1.
Figure 7:
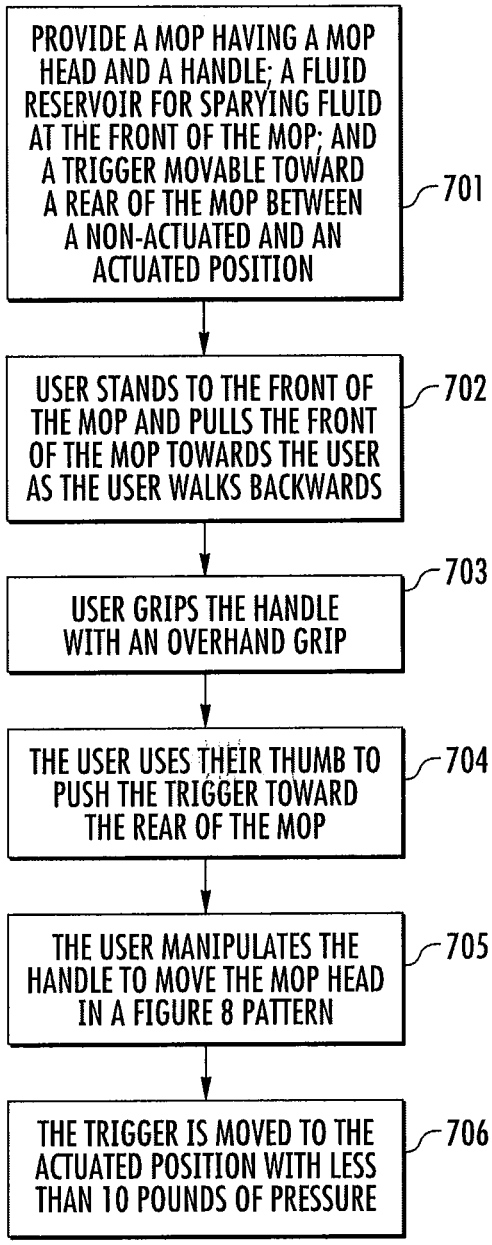
FIG. 7 is a block diagram illustrating a method of using the mop of the invention.

Referring to FIGS. 4 through 6, hand grip and thumb trigger mechanism 1 consists of a thumb trigger 2 having a thru hole 4 that extends through the thumb trigger 2. The hand grip 6 includes a four finger grip area 6*a* and a protective shroud 6*b* which surrounds the perimeter of the thumb trigger 2. Shroud 6*b* has an aperture 5 that receives the trigger 2 when the trigger is in the non-actuated position. FIGS. 4 and 5 show the thumb trigger 2 in its depressed or activated position where fluid is sprayed from reservoir 28. When a user releases the thumb trigger 2 it is returned to a substantially vertical position by a spring (not shown) that lifts the control rod 3 and returns the thumb trigger 2 to the non-actuated position. In the non-actuated position the thumb trigger 2 is located in aperture 5 in protective shroud 6*b*. The thru hole 4 allows the mop assembly to be hung on a nail or hook mounted to a wall. The protective shroud 5 protects the thumb trigger 2 from damage and facilitates the storage of the mop assembly in an inverted position in a quarter pallet display where the protective shroud is in contact with a support surface and supports the weight of the mop.

FIG. 5 is a cross-sectional view showing the thumb trigger 2 in the depressed or activated position. The lower end 2*a* of thumb trigger 2 is pivotably attached at a hinge comprising a pivot pin 9 to the hand grip 6. The thumb trigger 2 has a protrusion 7 which presses down onto the top surface 8 of a control rod 3 when the trigger 2 is depressed. The control rod 3 extends from the hand grip and thumb trigger mechanism 1 to the reservoir 28 and is located within a chamber 15 that extends along the length of the hand grip 6. The grip 6 is secured to handle 24 where handle 24 includes an internal chamber that extends from hand grip 6 to the reservoir 28 and receives the rod 3. Downward movement of the control rod 3 is communicated to the valve in reservoir 28 and activates or opens the valve to spray cleaning solution onto the floor to be cleaned via nozzle 30. The upper end 2*b* of the thumb trigger 2 is pivoted about pivot pin 9 such that the upper end 2*b* rotates toward the rear of the mop.

Referring to FIG. 4, to improve the ergonomics of the trigger mechanism and reduce strain on thumb and hand muscles, use of larger hand muscles Adductor Pollicis AP is maximized, while use of smaller/thinner thumb muscles Extensor Pollicis Longus is reduced. The trigger pivot point 9 is positioned lower relative to the user's thumb such that it is near the base of the user's thumb to maximize use of the Adductor Pollicis, and the angle needed to activate the trigger is minimized.

FIG. 4 shows the thumb trigger 2 when actuated by a user's hand H. The user maintains the overhand grip on the finger grip 6 with his or her fingers F while depressing the trigger 2 with the thumb T of the hand H. In an overhand grip the handle 24 is in the palm of the user's hand with the fingers F facing towards the rear of the mop and the thumb T facing upward toward mop handle grip and thumb trigger mechanism 1. The upper hand grip for a mop with the integrated trigger mechanism enables the end user to easily reach and activate the trigger 2 while mopping without having to release the remaining four fingers from the grip 6. The user is also able to grip the handle 24 without activating the trigger accidentally. In a preferred embodiment less than 10 lbs of pressure is required to move the trigger from the non-actuated to the actuated position and dispense fluid from the reservoir. The design facilitates the overhand hand grip required for the figure eight mopping method while walking backwards. The design also allows the hand grip/trigger to be inserted into and removed through a hole in a quarter pallet display for merchandising purposes and to merchandise the mop in the quarter pallet display with the trigger in its resting or non-actuated position where the mop rests on the shroud 6*b*. The hole 4 formed in trigger 2 also provides a mechanism for the end user to hang the handle on the wall from a hook or the like.

A method of using the mop will be described. A mop comprising a mop head and a handle; a fluid reservoir for spraying a fluid at the front of the mop head; and a trigger disposed on the handle remote from the mop head where the trigger is movable toward the rear of the mop between a non-actuated position and an actuated position as described herein is provided (Block 701). The user stands to the front of the mop and pulls the front of the mop toward the user as the user walks backward (Block 702). The user grips the handle with an overhand grip where the handle is in the palm of the user's hand with fingers of the hand facing towards the rear of the mop and the thumb facing upward (Block 703). The user uses their thumb to move the trigger toward the rear of the mop (Block 704) to actuate the reservoir and spray a liquid on the surface being mopped. The user moves the handle such that the mop head moves over the surface in a figure 8 motions (Block 705). Less than 10 lbs of pressure is applied by the user to the trigger to move the trigger from the no-actuated to the actuated position and dispense liquid from the reservoir (Block 706).

The mop of the invention may be made by injection molding the hand grip and thumb trigger of plastic. The hinge 9 and control rod 3 may be made of steel. The operational force of the thumb trigger may be less than 10 lbs. The hand grip 6 may be overmolded with a soft durometer material that provides more grip. The hand grip and trigger could also be made of cast aluminum or other material.

While embodiments of the invention are disclosed herein, various changes and modifications can be made without departing from the spirit and scope of the invention as set forth in the claims. One of ordinary skill in the art will recognize that the invention has other applications in other environments. Many embodiments are possible. The following claims are in no way intended to limit the scope of the invention to the specific embodiments described above.

The invention claimed is:

1. A mop comprising:

a mop head defining a first side and a second side and a handle connected to the mop head, said mop head and handle defining a front and a rear of the mop;

a fluid reservoir mounted on the mop and a nozzle operatively connected to the fluid reservoir and oriented for spraying a fluid from the fluid reservoir toward the first side of the mop head, the first side of the mop head defining the front of the mop and the second side of the mop head defining the rear of the mop;

a trigger movably disposed on the handle remote from the mop head, said trigger controlling the spraying of the fluid from the reservoir and movable between a non-actuated position and an actuated position, said trigger being thumb-operated and being accessed from the front of the mop and moving toward the rear of the mop as the trigger moves from the non-actuated position to the actuated position.

2. The mop of claim 1 comprising a pad secured to the mop head.

3. The mop of claim 1 wherein the mop head is secured to the handle at a pivot.

4. The mop of claim 3 wherein the pivot allows the mop head to pivot relative to the handle about a first axis and a second axis arranged perpendicular to the first axis.

5. The mop of claim 1 wherein the fluid reservoir is mounted on the handle.

6. The mop of claim 1 further comprising a hand grip mounted on the handle adjacent the trigger.

7. The mop of claim 1 wherein the trigger moves a control rod.

8. The mop of claim 7 wherein the control rod is located inside the handle.

9. The mop of claim 1 wherein the trigger is located at a distal end of the handle remote from the mop head and defines a hole that extends through the trigger and is exposed to the exterior of the mop.

10. The mop of claim 6 wherein the hand grip comprises a four finger grip area.

11. The mop of claim 6 wherein the hand grip comprises a protective shroud which closely surrounds the perimeter of the trigger when the trigger is in the non-actuated position.

12. The mop of claim 6 wherein the trigger is pivotably attached at a hinge.

13. The mop of claim 7 wherein the trigger comprises a protrusion which presses down on the control rod when the trigger is moved to the actuated position.

14. The mop of claim 1 wherein moving the trigger from the non-actuated position to the actuated position requires less than 10 lbs of pressure.

15. A method of using a mop comprising:

providing a mop comprising:

a mop head defining a first side and a second side and a handle connected to the mop head at a pivot, said mop head and handle defining a front and a rear of the mop;

a fluid reservoir for spraying a fluid from the fluid reservoir toward the first side of the mop head, the first side of the mop head defining front of the mop and the second side of the mop head defining the rear of the mop;

a trigger disposed on the handle remote from the mop head, said trigger controlling the spraying of the fluid and movable between a non-actuated position and an actuated position, said trigger moving toward the rear of the mop as the trigger moves from the non-actuated position to the actuated position;

standing in front of the mop and pulling the front of the mop toward the user as the user walks backward;

gripping the handle with an overhand grip where the handle is in the palm of a user's hand with fingers of the user's hand facing towards the rear of the mop and a thumb facing upward;

using the thumb to move the trigger toward the rear of the mop.

16. The method of claim 15 comprising moving the handle such that the mop head moves over a surface in a figure 8 motion.

17. The method of claim 15 wherein less than 10 lbs of pressure is applied by the user to the trigger to move the trigger from the non-actuated position to the actuated position and dispense a liquid from the reservoir.

18. A mop comprising:

a mop head defining a first side and a second side and a handle connected to the mop head, said mop head and handle defining a front and a rear of the mop;

a fluid reservoir mounted on the mop and a nozzle operatively connected to the fluid reservoir and oriented for spraying a fluid from the fluid reservoir toward the first side of the mop head, the first side of the mop head defining the front of the mop head and the second side of the mop head defining the rear of the mop;

a trigger movably disposed on the handle remote from the mop head, said trigger controlling the spraying of the fluid from the reservoir and movable between a non-actuated position and an actuated position, said trigger moving toward the rear of the mop as the trigger moves from the non-actuated position to the actuated position and a hand grip positioned on the handle below the trigger and being disposed such that the hand grip may be gripped by four fingers of a hand while the thumb of the same hand moves the trigger from the non-actuated position to the actuated position.

19. The mop of claim 18 wherein the trigger is located adjacent the end of the handle and the hand grip is disposed between the trigger and the fluid reservoir.

20. The mop of claim 18 wherein when the trigger in the non-actuated position, the handle and the hand grip are disposed substantially along a straight line.

* * * * *